US006699326B2

(12) United States Patent
Suszynski

(10) Patent No.: US 6,699,326 B2
(45) Date of Patent: Mar. 2, 2004

(54) APPLICATOR

(75) Inventor: Wieslaw J. Suszynski, Maple Plain, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 09/957,581

(22) Filed: Sep. 20, 2001

(65) Prior Publication Data

US 2002/0046697 A1 Apr. 25, 2002

Related U.S. Application Data

(60) Provisional application No. 60/234,618, filed on Sep. 22, 2000.

(51) Int. Cl.[7] ..... B05C 3/02

(52) U.S. Cl. ..... 118/411

(58) Field of Search ..... 222/137, 145.5, 222/334, 326, 575, 386; 118/411, 410, 419, 50, DIG. 2, DIG. 4; 401/5, 13, 14, 28, 35, 137, 138, 149, 150, 172, 176, 177, 218, 193

(56) References Cited

U.S. PATENT DOCUMENTS

| | | | | | |
|---|---|---|---|---|---|
| 2,249,401 | A | | 7/1941 | Sieg | 18/3.5 |
| 2,343,026 | A | * | 2/1944 | Radbruck | |
| 2,761,417 | A | | 9/1956 | Russell et al. | 118/410 |
| 2,761,418 | A | | 9/1956 | Russell et al. | 118/410 |
| 2,761,419 | A | | 9/1956 | Mercier et al. | 118/412 |
| 2,761,791 | A | | 9/1956 | Russell et al. | 117/34 |
| 3,088,434 | A | * | 5/1963 | Sprague et al. | |
| 3,334,792 | A | | 8/1967 | De Vries et al. | 222/289 |
| 3,357,856 | A | * | 12/1967 | Ragan et al. | |
| 3,413,143 | A | | 11/1968 | Cameron et al. | 117/120 |
| 3,508,947 | A | | 4/1970 | Hughes | 117/34 |
| 3,573,965 | A | | 4/1971 | Ishiwata et al. | 117/83 |
| 3,627,564 | A | | 12/1971 | Mercier | 117/69 |
| 3,656,428 | A | * | 4/1972 | Duncan | |
| 3,681,138 | A | | 8/1972 | Ankenbrand et al. | 117/238 |
| 4,001,024 | A | | 1/1977 | Dittman et al. | 96/87 |
| 4,157,149 | A | * | 6/1979 | Moen | |
| 4,291,642 | A | * | 9/1981 | Kolc | |
| 4,478,882 | A | * | 10/1984 | Roberto | |
| 4,489,671 | A | | 12/1984 | Choinski | 118/412 |
| 4,569,863 | A | | 2/1986 | Koepke et al. | 427/402 |
| 4,622,239 | A | * | 11/1986 | Schoenthaler et al. | |
| 4,665,723 | A | | 5/1987 | Zimmer | 68/200 |
| 4,894,259 | A | | 1/1990 | Kuller | 427/208.8 |
| 4,938,994 | A | | 7/1990 | Choinski | 427/96 |
| 4,961,955 | A | * | 10/1990 | Goldberg | |
| 4,994,306 | A | | 2/1991 | Takahashi et al. | 427/131 |
| 5,069,934 | A | | 12/1991 | Chino et al. | 427/131 |
| 5,072,688 | A | | 12/1991 | Chino et al. | 118/411 |
| 5,266,113 | A | * | 11/1993 | Konno | |
| 5,422,137 | A | | 6/1995 | Huebler et al. | 427/122 |
| 5,601,647 | A | | 2/1997 | Pertzsch et al. | 118/419 |
| 5,851,289 | A | | 12/1998 | Sato et al. | 118/411 |
| 6,158,338 | A | * | 12/2000 | MacRaild et al. | |
| 6,171,399 | B1 | * | 1/2001 | Kaiser et al. | |

OTHER PUBLICATIONS

2001/0027746, U.S. patent application Publication, Oct. 2001.*

* cited by examiner

*Primary Examiner*—Brenda A. Lamb
(74) *Attorney, Agent, or Firm*—Westman, Champlin & Kelly, P.A.

(57) ABSTRACT

An applicator includes a slot and a reservoir which extends from the slot and has a shape which generally conforms to the slot. The reservoir is configured to contain a liquid therein. A piston which conforms to the reservoir is configured to move in the reservoir to thereby urge the liquid in the reservoir toward the slot.

11 Claims, 7 Drawing Sheets

APPLICATOR

The present application is based on and claims the benefit of U.S. provisional patent application Serial No. 60/234,618, filed Sep. 22, 2000, the content of which is hereby incorporated by reference in its entirety.

BACKGROUND OF THE INVENTION

The present invention relates to applicator and to coaters of the type used to deposit a layer or layers of liquid onto an object such as a web or a sheet.

Various types of applicators are known in the art and are used to deposit layers of liquid onto objects. One type of applicator is known as a slot applicator and is used to deposit a thin layer of liquid over a wide area. Examples of such applicators are shown in U.S. Pat. No. 5,851,289, entitled "APPLICATOR", which issued Dec. 22, 1998 to Sony Corporation and U.S. Pat. No. 2,761,791, entitled "METHOD OF MULTIPLE COATING" which issued Sep. 4, 1956. These types of applicators are used to deposit layers of coatings in the production of magnetic tapes, adhesive tapes, photographic materials and paper, for example.

Typically, prior art slot applicators must be specially designed for the type of liquid which they will dispense and the particular relationship between the applicator and the substrate. Thus, it is frequently not possible to use a single applicator for more than one particular application. Applicators tend to be limited to a particular liquid and a particular substrate configuration. This also makes maintaining, reconfiguring or replacing applicators difficult, time consuming and expensive.

SUMMARY OF THE INVENTION

An applicator includes a slot and a reservoir which extends from the slot and has a shape which generally conforms to the slot. The reservoir is configured to contain a liquid therein. A piston which conforms to the reservoir is configured to move in the reservoir to thereby urge the liquid in the reservoir toward the slot.

DETAILED DESCRIPTION OF THE PREFERRED EMBODIMENTS

In various aspects, the present invention provides a slot applicator configuration which can be used for more than one particular type of liquid or substrate. The applicator of the present invention can be stacked in order to apply more than one layers of liquid. The invention includes the use of the applicator in a coating apparatus.

One aspect of the present invention includes the recognition that typical prior art slot applicators did not provide a universal solution, or even a general solution, whereby one applicator could be used for dispensing more than one type of liquid or in more than one type of configuration with a particular substrate. In attempting to design such a universal applicator, I realized that a major source of variations and design constraints was the reservoir which is used in typical prior art applicators. In such a configuration, the liquid is loaded into the reservoir and then forced out of the reservoir, at a relatively high pressure, through a conduit and toward the slot. The high pressure and physical configuration of the reservoir and narrow channel called a slot put stress on the liquid. Further, with such a configuration it is difficult to ensure uniform distribution of the fluid across the width of the slot. The configuration of these elements was therefore particularly dependent upon physical properties of the liquid being dispensed. Typically, a design optimized for one type of liquid would not then be optimized for another type of liquid.

Based upon this recognition, the present invention includes a slot applicator which does not require a reservoir.

Figure 1:
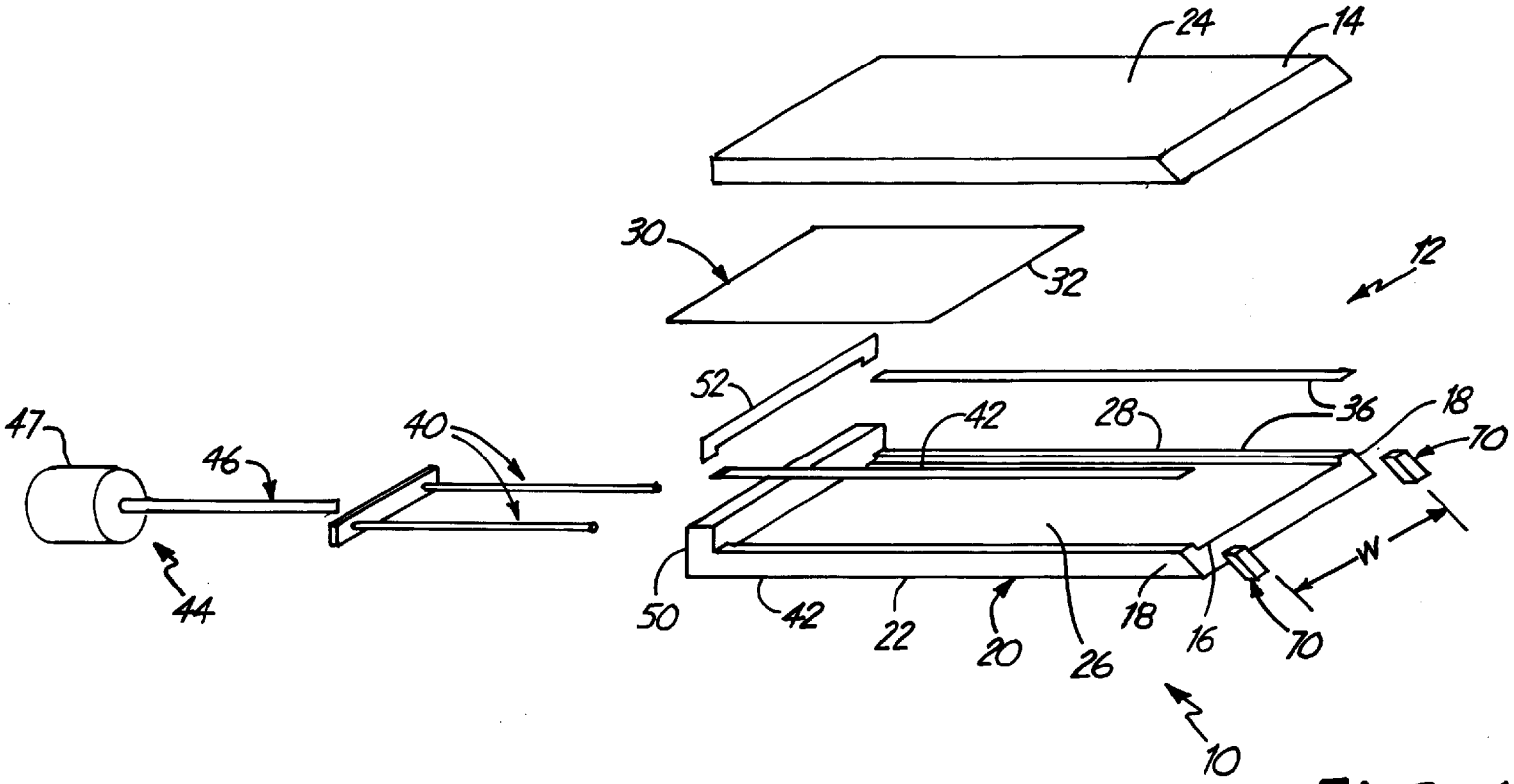
FIG. 1 is an exploded perspective view of a applicator (slide die configuration) in accordance with one example embodiment of the present invention.
Figure 2:
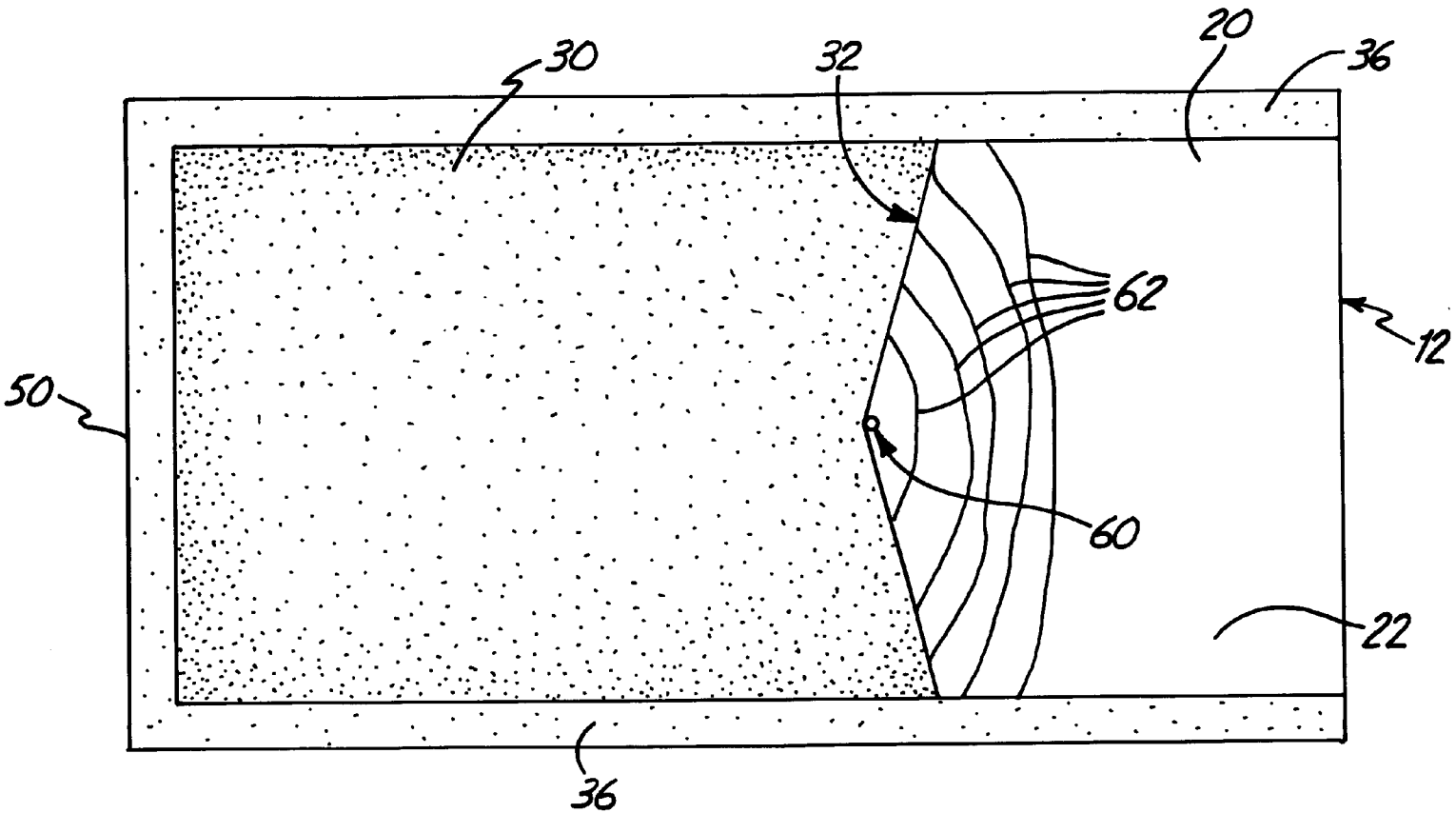
FIG. 2 is a top plan cross-sectional view of the applicator (slide die configuration) of FIG. 1.

FIG. 1 is a perspective exploded view and FIG. 2 is a top plan view of a slide applicator 10 in accordance with one example embodiment of the present invention. Slot applicator 10 includes a slot 12 which is formed by a top side 14 and a bottom side 16 with side walls 18 which extend therebetween. The top side 14 and bottom side 16 and slot 12 extend in a transverse direction having a width W. A reservoir 20 is configured to contain a liquid and has a shape which generally conforms to the shape of the slot 12. The reservoir 20 includes top and bottom walls 22 and 24 which are sealed by side walls 26 and 28. The piston 30 forms a seal against walls 22, 24, 26 and 28. A piston 30 fits in the reservoir and is configured to urge the liquid from the reservoir out through the slot 12. The leading edge of the piston 30 forms a seal 32 which provides a seal against walls 14 and 18 and side shims 36.

FIG. 1 also shows push rods 40 which are received in tracks 42 seen in bottom wall 22. Push rods 40 are coupled to an actuator 44 which can comprise, for example, a screw drive 46 driven by motor 47. The reservoir 20 is completed with a rear wall 50. A rear shim 52 is positioned adjacent rear wall 50. In the example embodiment found in FIG. 1, sides 14 and 16 have an angled surface, however, any appropriate configuration can be used.

FIG. 2 illustrates the angle formed at the leading edge of piston 30 by seal 32. Although other configurations can be used, an angled configuration reduces the likelihood that air will be trapped in the reservoir 20. The liquid is delivered through an orifice 60 which is carried in the wall 22. As the liquid is dispensed from orifice 60, it progresses through the stages indicated by liquid fronts 62. The angle of leading edge seal 32 urges the liquid in a continuous forward direction which reduces the likelihood that air is trapped behind the liquid front. Additionally, if the reservoir 20 is angled such that the slot 12 is at a higher position than the orifice 60, the air will tend to rise from the reservoir 20 and exit the reservoir 20 through slot 12.

Referring back to FIG. 1, applicator guides 70 are provided on both sides of slot 12. Applicator guides 70 are used to keep liquid on the angled surface (slide surface) of the slide die. When designed for the purpose of maintaining applicator substrate distance they can also serve this purpose. The guides 70 can be simple shims that have a desired size to provide the appropriate distance or angle between the slot 12 and the substrate or, in more complex embodiments, guides 70 can comprise wheels or other types of bearings to provide reduced friction. Guides 70 can be easily interchanged when a different separation distance is required, for example, if a different liquid is being dispensed or a different substrate is being used. The guides 70 are an economical way to provide a mechanism to follow the topography and contours of the substrate without requiring a separate control mechanism.

Figure 3A:
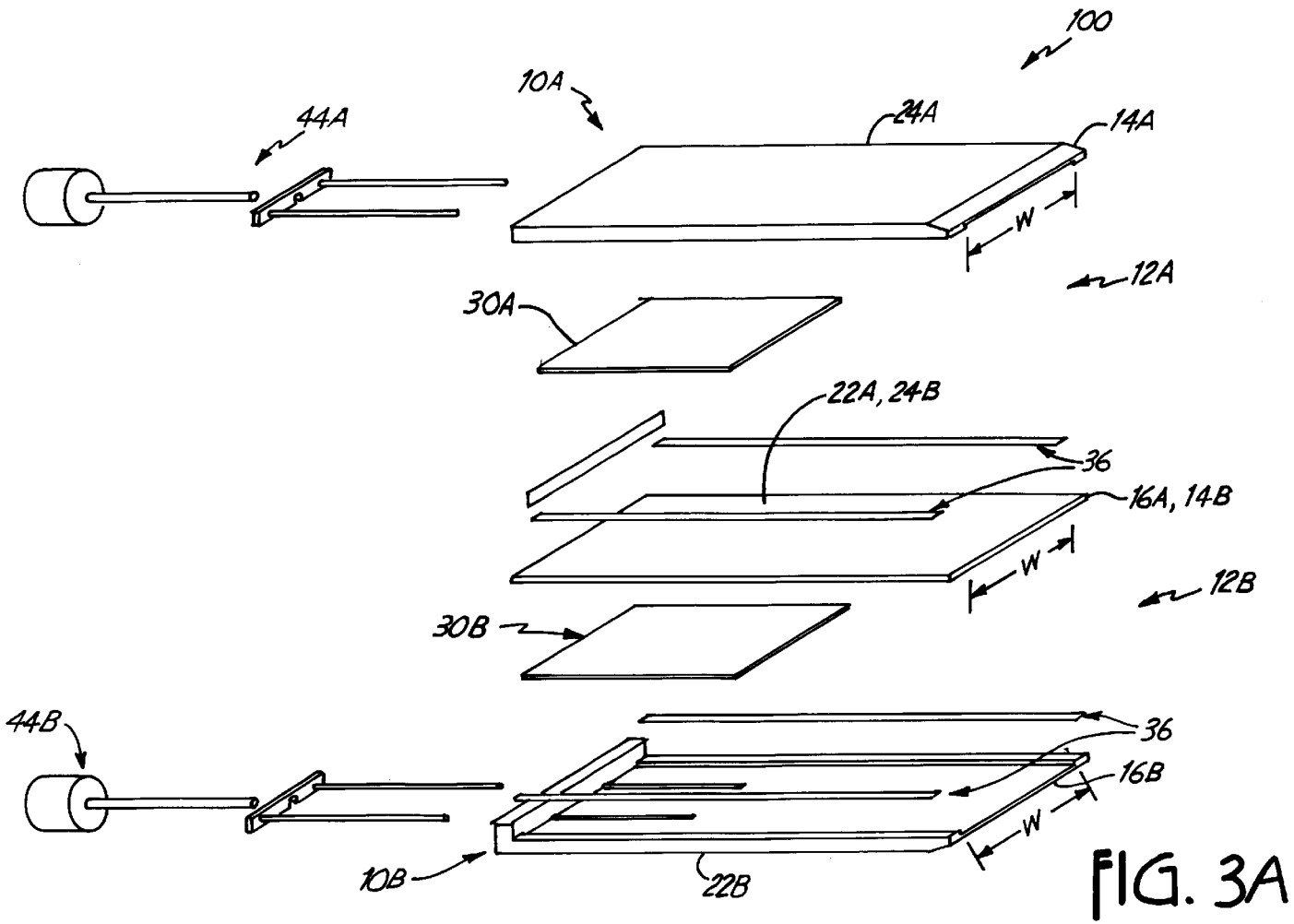
FIGS. 3A and 3B are exploded perspective views showing a multiple slot applicator configuration of the invention.
Figure 3B:
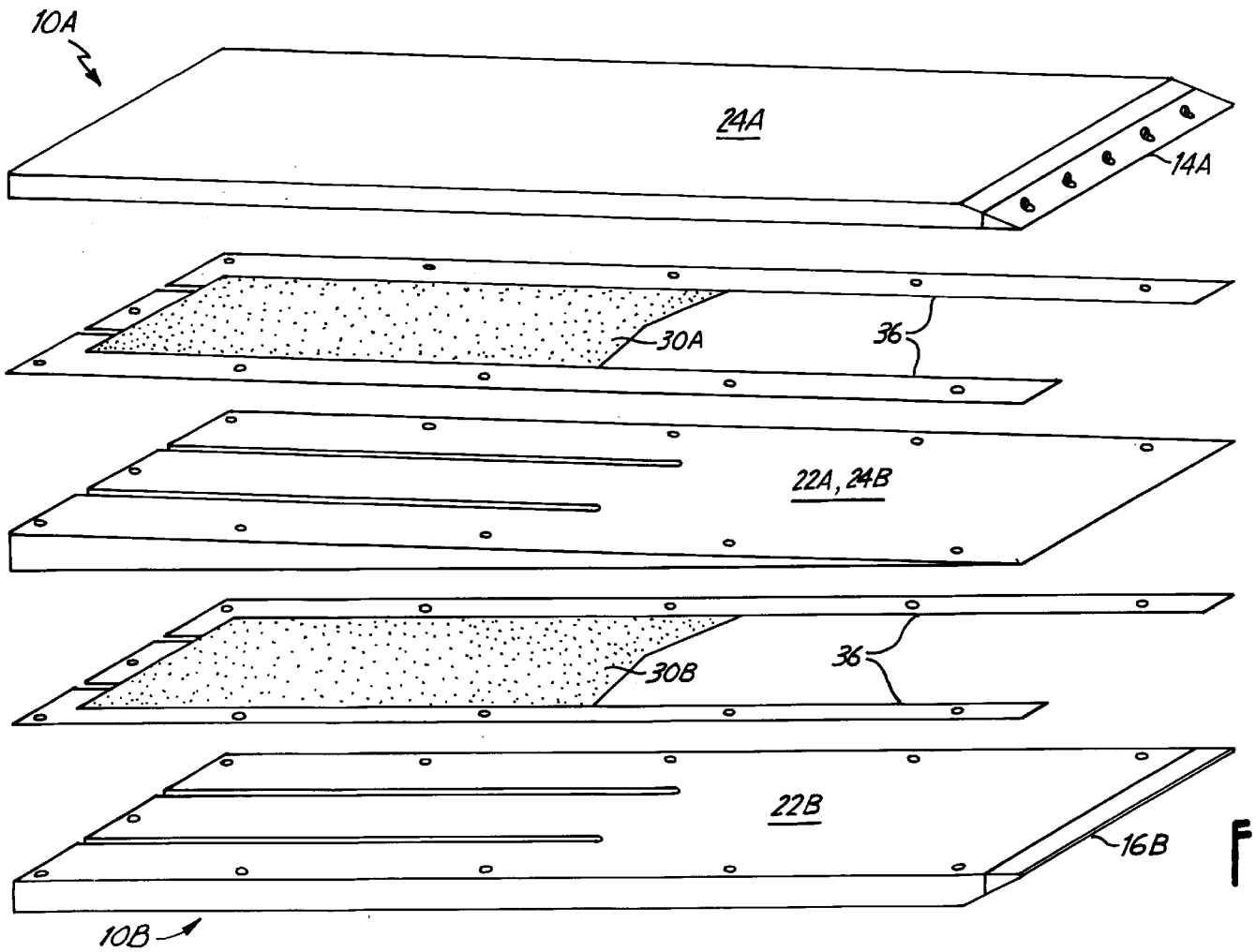

FIGS. 3A and 3B are exploded perspective views of an applicator 100 having multiple slots for dispensing a liquid. In the embodiment of FIGS. 3A and 3B, only two individual applicators, 10A and 10B are illustrated. However, any number of such applicators can be stacked as desired. In FIG. 3, letters have been added to the numerals used to identify elements in FIG. 1 such that similar numerals can be used for similar elements. Note that in FIG. 3 a single piece can be used which functions as both a bottom side 22A for applicator 10A and as a top side 24B or applicator 10B. Note that with the invention elements do not need to be shared in this manner. FIG. 3 also illustrates opposed tapers to top side 14A and bottom side 16B such that the two slots of applicator 100 come to a point. This configuration is known as a slot die. FIG. 3B illustrates removably replaceable lips 14A and 16B.

Figure 4:
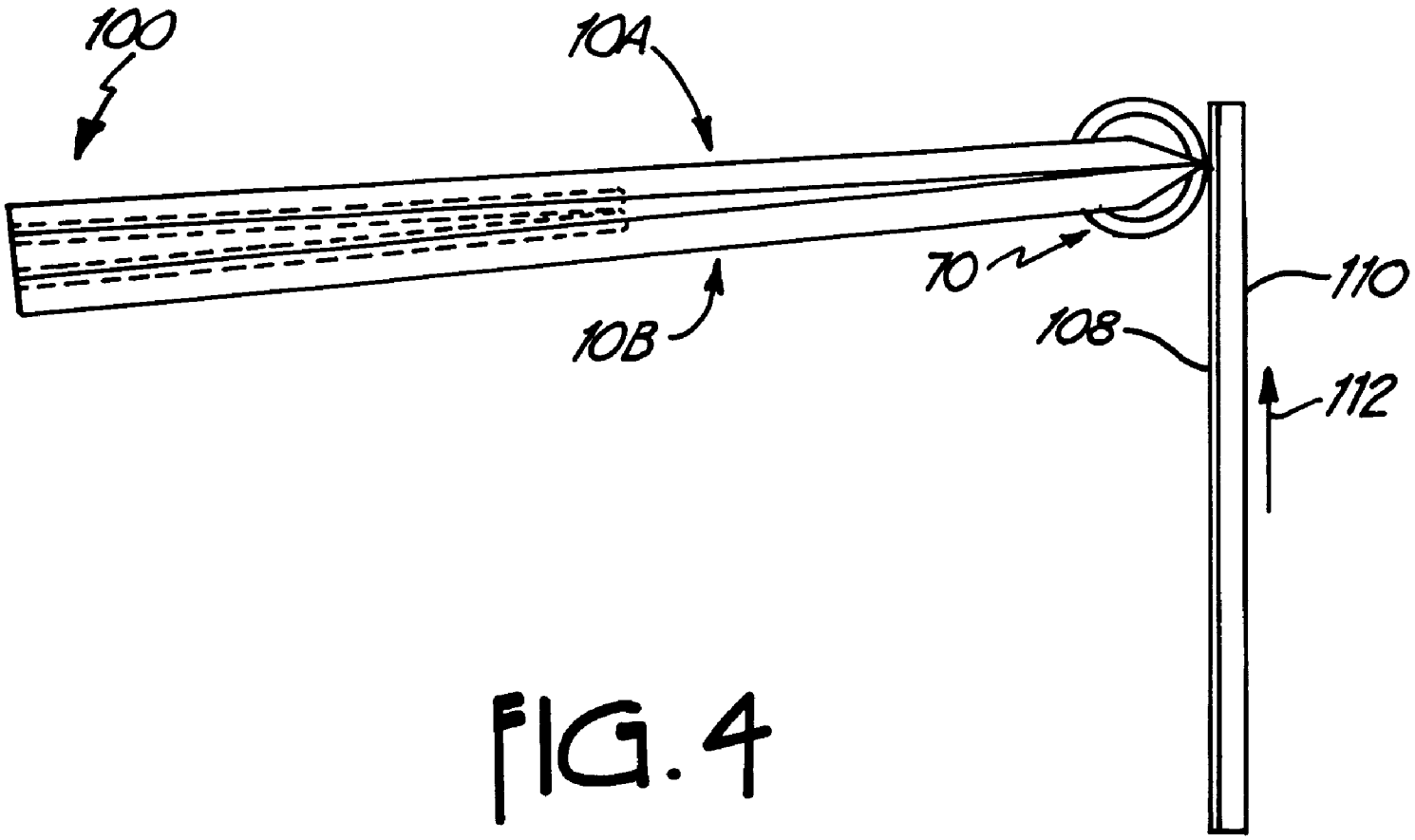
FIG. 4 is a side cross-sectional view showing the multiple slot applicator of FIG. 3.

FIG. 4 is a side cross-sectional view of applicator 100 shown in the process of applying a film of liquid to a substrate 108. Substrate 108 is carried on a backing plate and moved in the direction indicated by arrow 112. In the embodiment illustrated in FIG. 4, guide 70 is illustrated as a wheel or roller which is used to maintain the distance between the applicator 100 and substrate 108. This distance can be adjusted by changing the diameter of the wheel or by altering the position of its axis. The distance can also be maintained by installing the applicator on a positioning mechanism.

Figure 5:
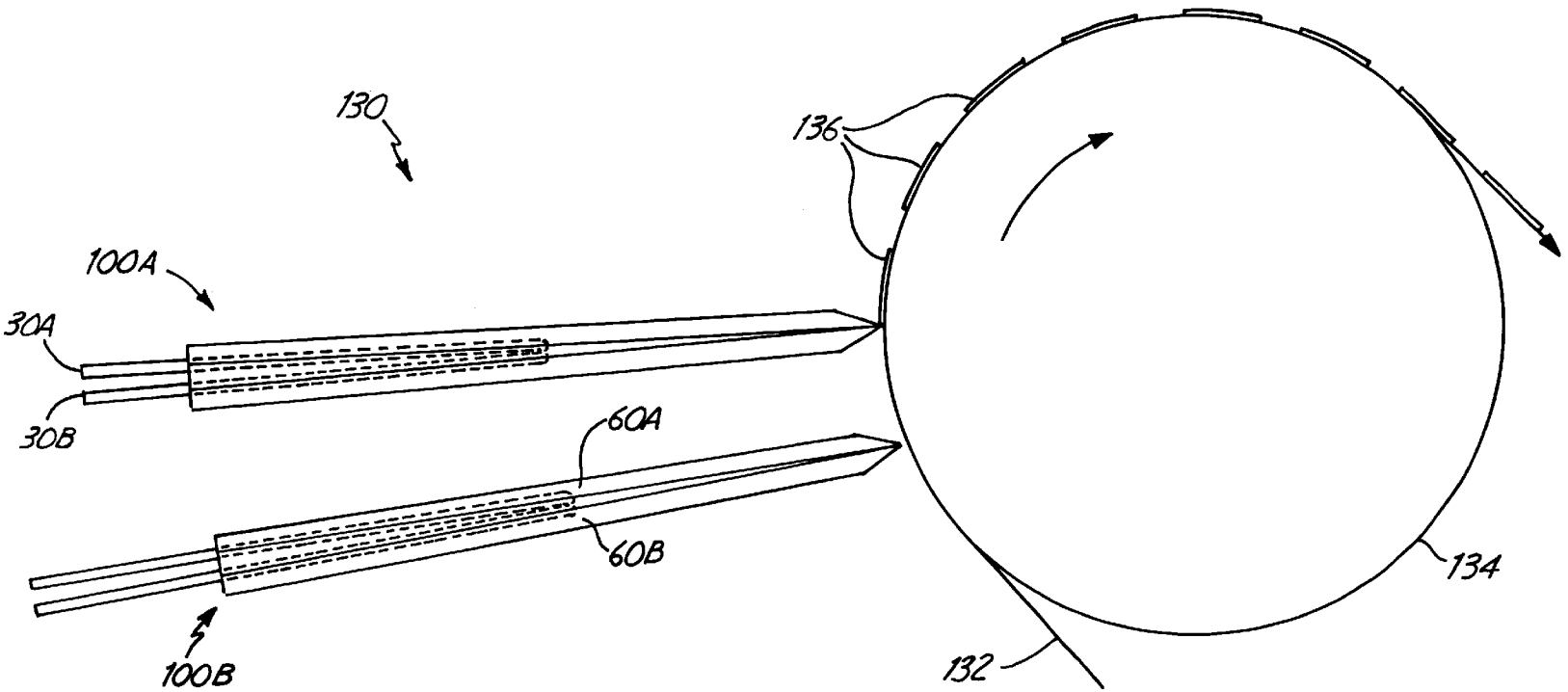
FIG. 5 is a side view showing two spaced apart applicators.

FIG. 5 is a cross-sectional view of a coating device 130 which uses multiple dies, 100A and 100B. A web 132 is carried on some type of movement device such as roller 134. Applicators 100A and 100B deposit patches 136 of multilayer liquid onto web 132. During operation, dies 100A and 100B are used alternately such that when one of the dies is emptied, the die can be filled through orifice 60A, B while the other die is used to deposit patch or patches 136. In FIG. 5, pistons inside the die 100A moved forward by rods 30A, 30B are urging liquid out to form patches 136 while die 100B is filled.

Figure 6:
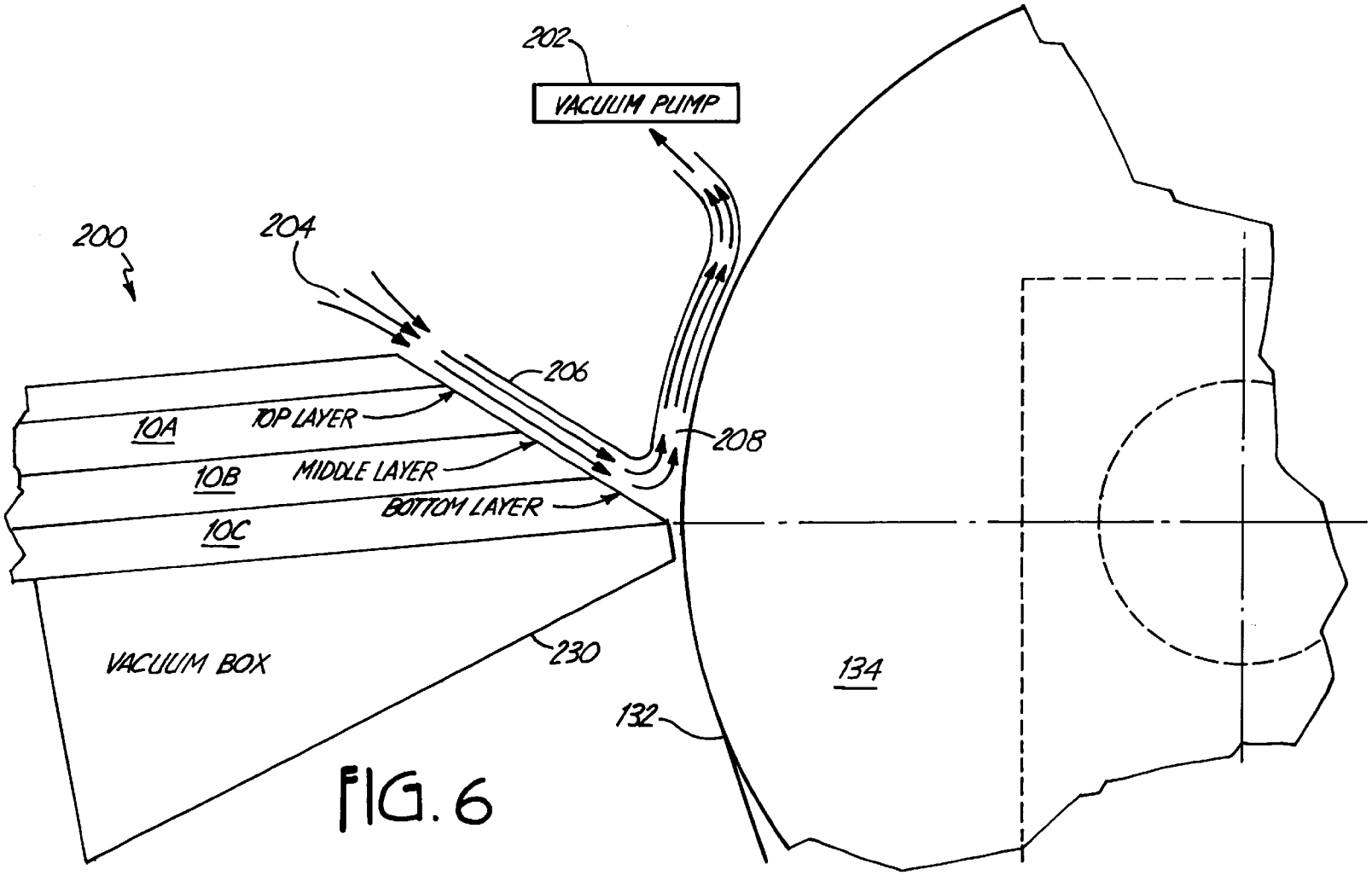
FIG. 6 is a side cross-sectional view of an applicator (slide die) including a vacuum to assist in initial liquid application.

FIG. 6 is a cross-sectional view of an applicator slide coating die 200 in accordance with another aspect of the present invention. Applicator 200 is shown as being configured to deposit a layer of liquid onto web 132 carried on roller 134. A vacuum pump 202 generates an air flow 204 between slide surface and shield 206. Shield 206 includes a partial opening 208 such that the vacuum from vacuum pump 202 draws a layer of liquid from applicators 10A, 10B and 10C which is then deposited onto web 132 through opening 208. In an alternative configuration, a vacuum is applied behind the web 132 through a roller or belt which has perforations. In this configuration the vacuum is drawn through the web such that the liquid is drawn from the applicators. Note that FIG. 6 is an illustration of a applicator die having three separate applicators for depositing three layers of liquid. Upstream vacuum box 230 can be used to draw the liquid from the applicator to provide increased coating spreads. The vacuum box 230 can be used with or without the shield 206 and vacuum pump 202.

The applicator coating die of the present invention can be constructed from relatively thin material plates because the liquid pressure inside the applicator is small. Because the applicator plates are thin it is possible to build a slot coating die which has multiple, stacked applicators for providing multiple layers of liquid for simultaneous coating. Further, prior art applicators require additional spacing for the liquid distribution cavity and, in some instances, a secondary distribution chamber limiting the amount of coated layers to usually 3–4 for slot coating. The use of applicators can be staggered such that one applicator can be filling while another applicator is dispensing liquid. In one embodiment, the applicator is tilted at a small angle such that air is not trapped during the filling process. In another aspect, the lips which form the slot are removable and replaceable such that lips having differing geometric shapes can be easily interchanged. Flow restricting elements can be built into the lips in the form of teeth or grooves such that liquid stripes are extruded from the applicator. This also allows for the orientation of particles of the coating liquid. Air flow between slide die surface and a shield, generated by a vacuum pump, for example, can be used to initialize the coating process. The substrate can be carried on a wheel or flexible belt. Additionally, the substrate can be attached to a rigid substrate such as a glass plate. The rigid substrate is then moved past the applicator.

Although the present invention has been described with reference to preferred embodiments, workers skilled in the art will recognize that changes may be made in form and detail without departing from the spirit and scope of the invention. The invention can be used with other types of applicators and is not limited to slot die configuration illustrated herein, such as slide and curtain dies, and the figures can be considered as illustrations of such.

What is claimed is:

1. A liquid applicator for depositing a liquid on a substrate, comprising:

an open slot having a top slot side and a bottom slot side extending generally parallel and in a transverse direction which define a slot width extending along a longitudinal axis and first and second opposed sides that extend between the top and bottom slot sides which define a slot height, the slot configured to dispense the liquid directly onto the substrate;

an elongate open reservoir which extends from the slot in a direction away from the substrate and has a cross-sectional shape which generally conforms to the slot, the reservoir configured to contain the liquid therein and shaped to create a layer of the liquid having a height and width substantially the same as the slot height and width; and a piston which conforms to the reservoir and forms a fluidic seal therebetween, the piston configured to move in the reservoir to urge the layer of liquid in the reservoir out of the slot and onto the substrate wherein the layer of the liquid is applied to the substrate having a width substantially the same as the slot width wherein the reservoir includes a orifice through which the liquid is supplied to the reservoir and wherein the piston includes a seal configured to seal against an interior of the reservoir and form an angle relative to the longitudinal axis of the slot such that the liquid supplied to the reservoir from the orifice is urged to flow from the orifice to the slot by movement of a leading edge of the seal against the liquid contained in the reservoir.

2. The applicator of claim 1 wherein the reservoir has a rectangular shape.

3. The applicator of claim 1 wherein the slot includes replaceable lips.

4. The applicator of claim 1 wherein the piston is substantially flat in shape.

5. The applicator of claim 1 including a second slot, a second reservoir and a second piston configured to fit therein, the second slot configured adjacent the first slot to deposit multi-layer liquids.

6. The applicator of claim 5 wherein the first and second reservoirs share a wall.

7. The applicator of claim 1 including a vacuum source configured to draw liquid from the slot to initiate deposition of the liquid on the substrate.

8. The applicator of claim 7 wherein the vacuum is drawn between a shield and the applicator surface.

9. The applicator of claim 7 wherein the vacuum is drawn through the substrate backing surface.

10. The applicator of claim 1 including a guide configured to maintain a separation distance between the slot and the substrate.

11. The applicator of claim 10 wherein the guide comprises a wheel.

* * * * *

UNITED STATES PATENT AND TRADEMARK OFFICE

CERTIFICATE OF CORRECTION

PATENT NO. : 6,699,326 B2
DATED : March 2, 2004
INVENTOR(S) : Wieslaw J. Suszynski It is certified that error appears in the above-identified patent and that said Letters Patent is hereby corrected as shown below:

Column 4,
Line 39, after "axis" insert -- , --.

Signed and Sealed this

Twenty-first Day of September, 2004

JON W. DUDAS
*Director of the United States Patent and Trademark Office*